US008013535B2

(12) United States Patent
Jozwik

(10) Patent No.: US 8,013,535 B2
(45) Date of Patent: Sep. 6, 2011

(54) FLASH PATTERN SELECTION VIA POWER SWITCH

(75) Inventor: Jacek J. Jozwik, Mokena, IL (US)

(73) Assignee: Federal Signal Corporation, Oak Brook, IL (US)

( * ) Notice: Subject to any disclaimer, the term of this patent is extended or adjusted under 35 U.S.C. 154(b) by 838 days.

(21) Appl. No.: 11/840,062

(22) Filed: Aug. 16, 2007

(65) Prior Publication Data

US 2009/0045754 A1 Feb. 19, 2009

(51) Int. Cl.
*H05B 37/00* (2006.01)

(52) U.S. Cl. ..... 315/200 A; 315/316

(58) Field of Classification Search ..... 315/185 S, 315/200 A, 209 R, 291, 295, 307, 308, 316; 362/103, 227, 800
See application file for complete search history.

(56) References Cited

U.S. PATENT DOCUMENTS 4,418,333 A * 11/1983 Schwarzbach et al. .. 340/310.11
5,059,871 A * 10/1991 Pearlman et al. ..... 315/316
5,187,655 A * 2/1993 Post et al. ..... 700/17
5,461,288 A * 10/1995 Chaves et al. ..... 315/241 P
5,644,291 A 7/1997 Jozwik
5,877,681 A 3/1999 Williams et al.
6,100,791 A 8/2000 Bader et al.
6,304,422 B1 * 10/2001 Sander et al. ..... 361/84
6,600,270 B2 * 7/2003 Belliveau ..... 315/200 A
6,778,078 B1 8/2004 Han et al.
6,906,472 B2 * 6/2005 Wong ..... 315/200 A
2005/0116667 A1 6/2005 Mueller et al.

FOREIGN PATENT DOCUMENTS

WO 97/01912 1/1997

* cited by examiner

*Primary Examiner* — Jacob Y Choi
*Assistant Examiner* — Jimmy T Vu
(74) *Attorney, Agent, or Firm* — Merchant & Gould P.C.

(57) ABSTRACT

Lighting apparatus, systems and methods are disclosed. One lighting apparatus includes a light source, a power source in electrical communication with the light source, and a power button arranged to control electrical flow from the power source to the light source. The lighting apparatus also includes a programmable circuit in electrical communication with the power button, where the programmable circuit is programmed to set predetermined flash patterns for illuminating the light source in response to detecting a predetermined sequence of actuations of the power button.

32 Claims, 9 Drawing Sheets

FLASH PATTERN SELECTION VIA POWER SWITCH

TECHNICAL FIELD

The present disclosure relates to using a light source. In particular, the present disclosure relates to using a power button to actuate various flash patterns for illuminating the light source.

BACKGROUND

Electronic devices commonly use an internal or external power source with at least a power switch or an on/off power button. Electronic devices with programmable features often need extra buttons, programming pins, and/or wires. Those extra buttons, pins or wires have various disadvantages. Such disadvantages include additional cost, weight, space, work, etc. In addition, it is often awkward to access and operate extra buttons, pins and wires.

For these and other reasons, improvements are desirable.

SUMMARY

In accordance with the present disclosure, the above and other problems are solved by the following:

In a first aspect, a lighting apparatus is disclosed. The lighting apparatus includes a light source, a power source in electrical communication with the light source, and a power button arranged to control electrical flow from the power source to the light source. The lighting apparatus also includes a programmable circuit in electrical communication with the power button, where the programmable circuit is programmed to set predetermined flash patterns for illuminating the light source in response to detecting a predetermined sequence of actuations of the power button.

In a second aspect, a method of using a light source is disclosed. The method includes controlling electrical flow from a power source to the light source. The method also includes setting predetermined flash patterns for illuminating the light source in response to detecting a predetermined sequence of actuations of the power button.

In a third aspect, a method of using a lighting apparatus is disclosed. The lighting apparatus includes a light source, a power source in electrical communication with the light source, a power button arranged to control electrical flow from the power source to the light source, and a programmable circuit in electrical communication with the power button, where the programmable circuit is programmed to set predetermined flash patterns for illuminating the light source in response to detecting a predetermined sequence of actuations of the power button. The method includes pushing the power button to actuate predetermined flash patterns for illuminating the light source. The method also includes pushing the power button to program the predetermined flash patterns for the light source.

In a fourth aspect, a lighting system is disclosed. The lighting system includes a light source, a power source in electrical communication with the light source, and a power button arranged to control electrical flow from the power source to the light source. The lighting system also includes a programmable circuit in electrical communication with the power button, where the programmable circuit is programmed to set predetermined flash patterns for illuminating the light source in response to detecting a predetermined sequence of actuations of the power button.

DETAILED DESCRIPTION

Figure 1:
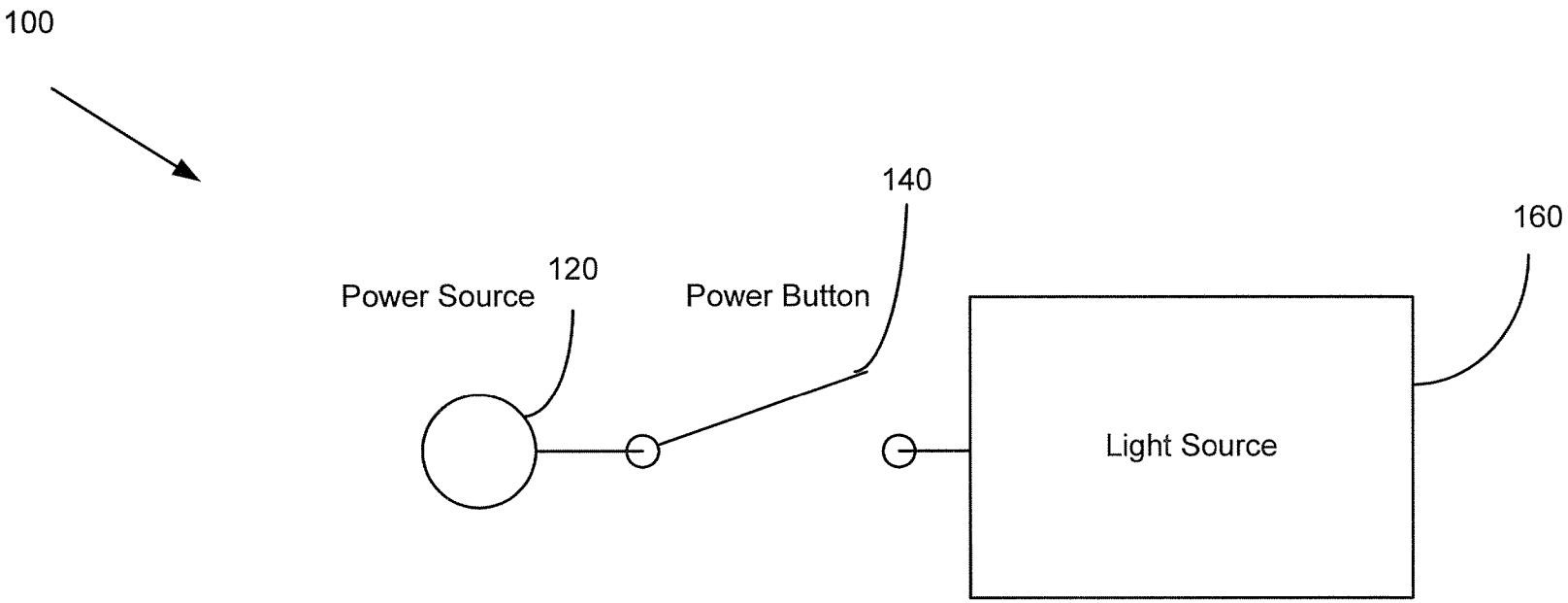
FIG. 1 shows a schematic of an exemplary lighting apparatus and system according to a possible embodiment of the present disclosure.

Various embodiments of the present invention will be described in detail with reference to the drawings, wherein like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

In general the present disclosure relates to using a power button to control electrical flow from a power source to a light source or other load source. The present disclosure relates to using a power button to actuate predetermined flash patterns for illuminating the light source. A programmable circuit is in electrical communication with the power button. The programmable circuit is programmed to set predetermined flash patterns for illuminating the light source in response to detecting a predetermined sequence of actuations of the power button.

Referring now to the figures and in particular to FIG. 1, a schematic of a lighting apparatus and system 100 is shown according to a possible embodiment of the present disclosure. Preferably, the lighting apparatus 100 includes a power source 120, a power button 140, and a light source 160. The power source 120 is in electrical communication with the light source 160 via the power button 140. The power source 120 is any of a number of sources to provide electrical power sufficient for the light source 160. The power source 120 can be a current source, a voltage source, or any other suitable source. In one embodiment, the power source 120 is an internal power source. In other words, the internal power source is integrated into the light apparatus 100. In another embodiment, the power source 120 is an external power source. The external power source can be separated and detached from the lighting apparatus 100.

The power button 140 is configured and arranged to control electrical flow from the power source 120 to the light source 160. For example, by pressing the power button 140, the power source 120 is electrically connected to the light source 160 and the light source 160 illuminates. By pressing the power button 140 again, the power source 120 is electrically disconnected from the light source 160 and the light source 160 is not illuminated. In another possible embodiment, the power button 140 can be a toggle switch. In yet another possible embodiment, the power button 140 can be any kind of suitable power switch to control electrical flow from the power source 120 to the light source 160. In yet another possible embodiment, the power button 140 may not be necessary to be in the lighting apparatus 100. For example, if the lighting apparatus is permanently turned on, or contains an automated power switch, such as a day/night sensor or the like, the electrical communication and programming function discussed above may be performed by manually connecting and disconnecting the power wire. In an alternative embodiment, the power button 140 is temporary and can be removed after the system 100 has been programmed to perform the desired function.

Preferably, the light source 160 includes a light emitting diode (LED). The light source 160 can also include any other suitable source such as a lamp. In one possible embodiment, the light source 160 is usable in or on a motor vehicle. In particular, the light source 160 can be used in an emergency response vehicle.

Preferably, the light apparatus 100 includes a programmable circuit. The programmable circuit is in electrical communication with the power source 120, the power button 140, and the light source 160. In particular, the programmable circuit is programmed to set predetermined flash patterns for illuminating the light source 160 in response to detecting a predetermined sequence of actuations of the power button 140. By the term "flash patterns" it is meant that the light source 160 can be illuminated in various ways. For example, the light source 160 can be constantly illuminated or flash on and off in 1 second intervals. Various flash patterns are possible. In another example, the light source might be illuminated for 2 seconds, off for 1 second, followed by illuminated for 4 seconds, and off for 2 seconds.

Figure 2:
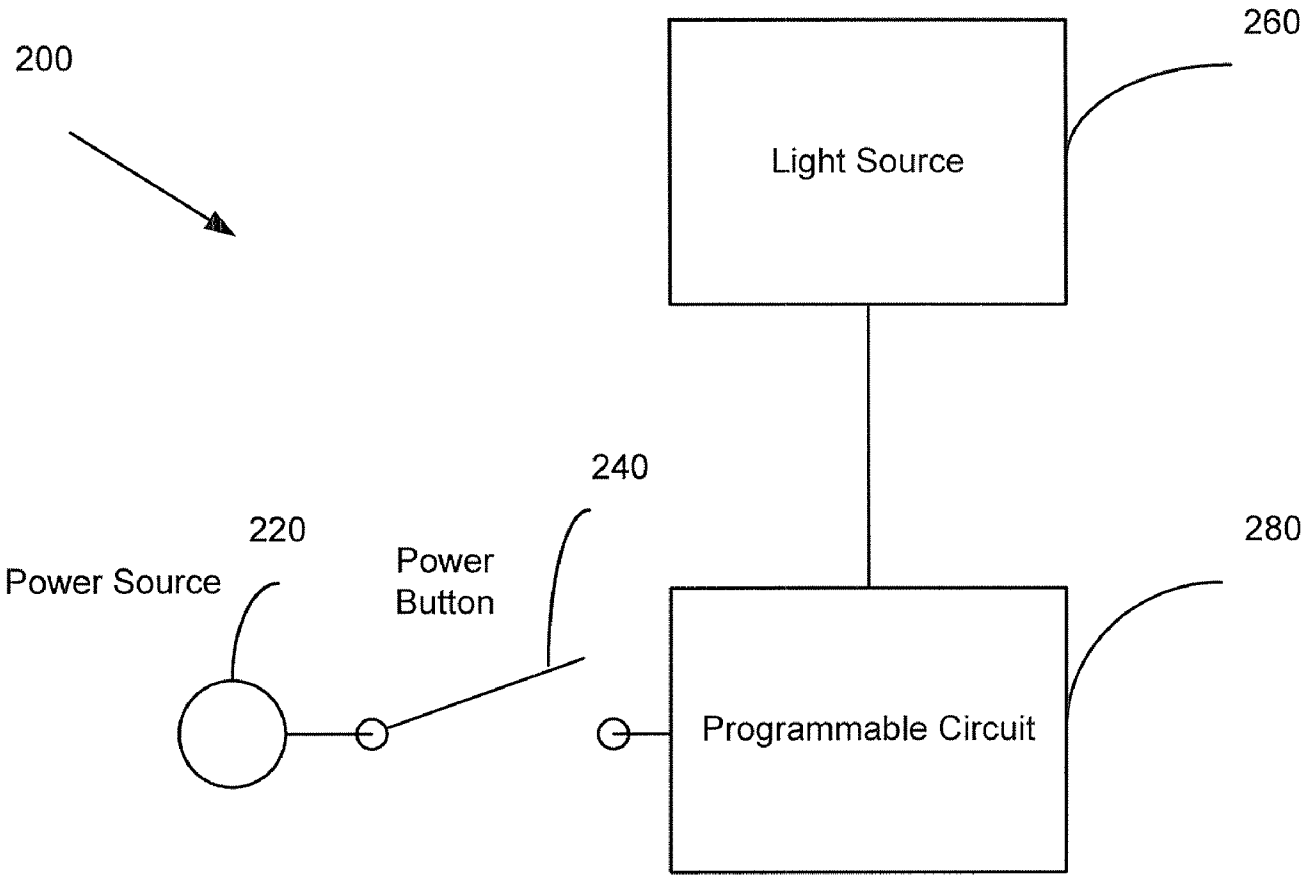
FIG. 2 shows a schematic of an exemplary lighting apparatus and system according to a possible embodiment of the present disclosure.

Referring to FIG. 2, a schematic of a lighting apparatus and system 200 is shown according to a possible embodiment of the present disclosure. Preferably, the lighting apparatus 200 includes a power source 220, a power button 240, and a light source 260. The power button 240 is configured and arranged to control electrical flow from the power source 220 to the light source 260. Preferably, the light source 260 includes an LED. The light source 260 can also include any other suitable source such as a lamp.

Preferably, the light apparatus 200 includes a programmable circuit 280. The programmable circuit 280 is in electrical communication with the power source 220, the power button 240, and the light source 260. In particular, the programmable circuit 280 is programmed to set predetermined flash patterns for illuminating the light source 260 in response to detecting a predetermined sequence of actuations of the power button 240.

Figure 3:
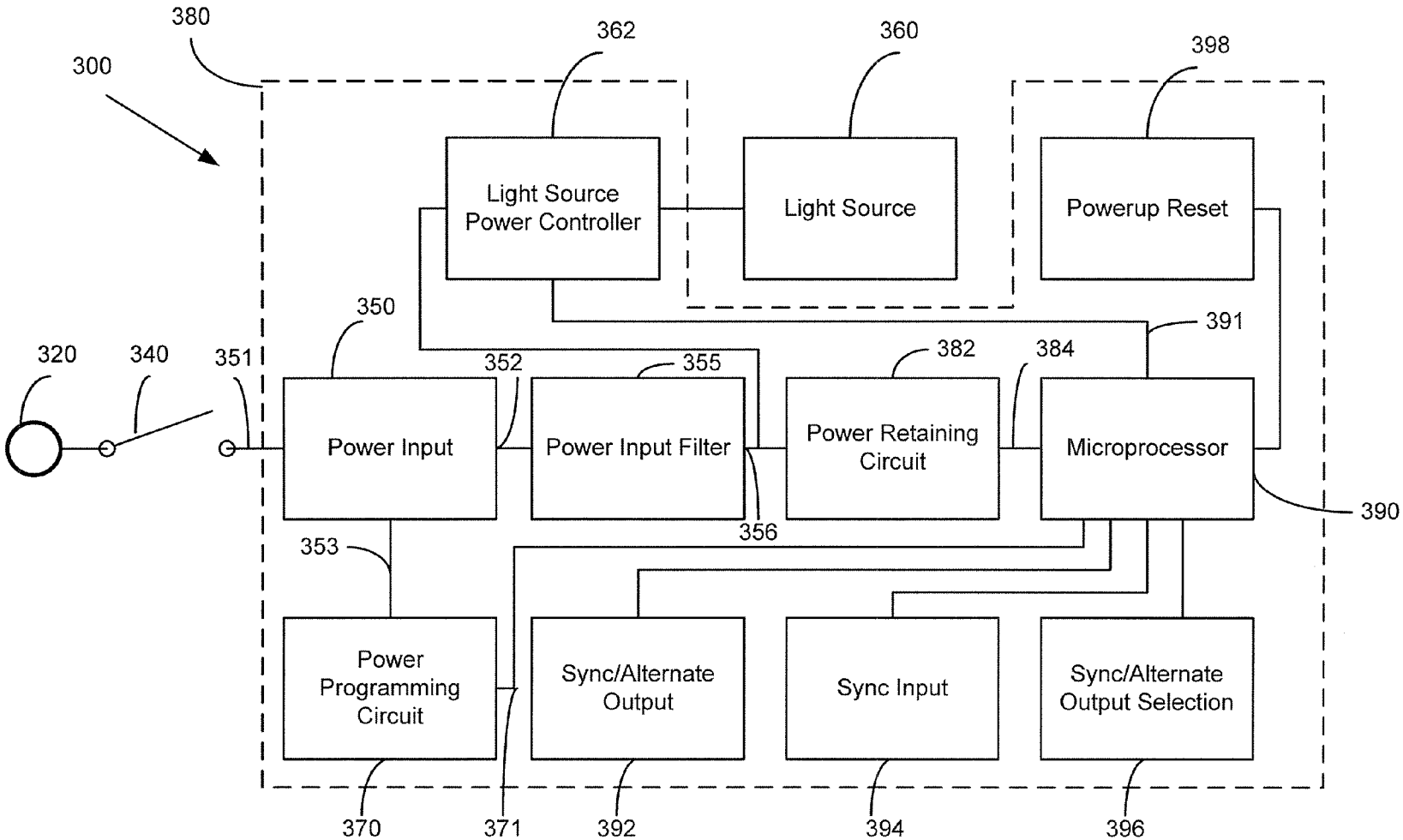
FIG. 3 shows a schematic block diagram of an exemplary lighting apparatus and system according to a possible embodiment of the present disclosure.

Referring now to FIG. 3, a schematic block diagram of a lighting apparatus and system 300 is shown according to a possible embodiment of the present disclosure. Preferably, the lighting system 300 includes a power source 320, a power button 340, a light source 360, and a programmable circuit 380. The power source 320 is in electrical communication with the light source 360 via the power button 340. The power button 340 is configured and arranged to control electrical flow from the power source 320 to the light source 360. The programmable circuit 380 is in electrical communication with the power source 320, the power button 340, and the light source 360.

Preferably, the programmable circuit 380 includes a power input circuit 350 and a power input filter circuit 355, which provide a suitable power for operations of components in the programmable circuit 380. The programmable circuit 380 also includes a power programming circuit 370 and a power retaining circuit 382, which provide inputs and power for a microprocessor 390 in the programmable circuit 380. Besides the microprocessor 390, the programmable circuit 380 further includes various auxiliary circuits to provide necessary inputs/outputs and initialization to support running the microprocessor 390 in the programmable circuit 380. The various auxiliary circuits, for example, include a sync/alternate output 392, a sync input 394, a sync/alternate output selection 396, and a power-up reset 398. Finally, the programmable circuit 380 includes a light source power controller 362, which controls the power flowing to the light source 360 and responds to the on and off commands from the microprocessor 390 by turning the light source 360 on and off or modifying the power level.

The power input circuit 350 receives a power input 351 from the power source 320 through a control of the power button 340. The power input circuit 350 provides a first power output 352 to the power input filter circuit 355. The power input circuit 350 also provides a second power input 353 to the power programming circuit 370. The power input circuit 350 is configured and arranged to provide a reverse polarity protection of the power source 320.

The power input filter circuit 355 receives the first power output 352 from the power input circuit 350. The power input filter circuit 355 filters the first power output 352. The power input filter circuit 355 generates a third power output 356 to the light source power controller 362 and the power retaining circuit 382. The third power output 356 provides a power for electrical operations in the light source power controller 362 and the light source 360.

The power programming circuit 370 receives the second power output 353 from the power input circuit 350. The power programming circuit 370 transforms the second power output 353 into a logical signal 371. The power programming circuit 370 generates the logical signal 371 in response to turning on and off the power source 320. For example, when the power source 320 is turned on, the logical signal 371 has a high logic level. On the other hand, when the power source 320 is turned off, the logical signal 371 has a low logic level.

The power retaining circuit 382 receives the third power output 356 from the power input filter circuit 355. The third power output 356 continues to run through the power retaining circuit 382. The power retaining circuit 382 generates a fourth power output 384. Typically, a voltage of the fourth power output 384 is between 0 and 10 volts, and preferably about 5 volts, for the fourth power output 384 to be used as a power input for the microprocessor 390. Of course, the power retaining circuit 382 can be appreciated to generate the fourth power output 384 with a suitable power voltage for various microprocessors or electrical devices as a power input. Further, the power retaining circuit 382 is configured and arranged to retain the fourth power output 384 in an approximately similar power voltage level after the power source 320 is turned off. The fourth power output 384 can typically be kept in the same power voltage level for about 1 to 10 seconds, preferably 2 to 5 seconds, even after the power source 320 is turned off. In an alternative embodiment, a battery can be used as a power retaining means to replace or work as a backup for the power retaining circuit 382 when the power retaining circuit 382 does not function.

The microprocessor 390 receives the fourth power output 384 from the power retaining circuit 382 as a power input to keep the microprocessor 390 running. The microprocessor 390 also receives the logical signal 371 to monitor the power on/off state of the power source 320. As discussed above, the various auxiliary circuits are provided to support running and executing the microprocessor 390 in the programmable circuit 380. The sync/alternate output 392, the sync input 394, and the sync/alternate output selection 396 provide synchronization and I/O data communication for the microprocessor to synchronize multiple lighting apparatus to flash together or flash alternately with the lighting apparatus 300. The power-up reset 398 provides a function for the microprocessor 390 to be reset. The microprocessor 390 delivers a control signal 391 to the light source power controller 362 for illuminating the light source 360 according to the predetermined flash patterns. Preferably, the microprocessor 390 is a microcontroller made from Microchip Technology Inc. A typical model used in the system 300 is PIC12F629. The microprocessor 390 can also be any other suitable type of processors or microcontrollers or control circuits.

Finally, the programmable circuit 380 includes the light source power controller 362, which controls the power level and the on and off of the light source 360. The light source power controller 362 receives the third power output 356 from the power input filter circuit 355. The light source power controller 362 also receives the control signal 391 from the microprocessor 390 to eventually control the light source 360 to flash.

Figure 4:
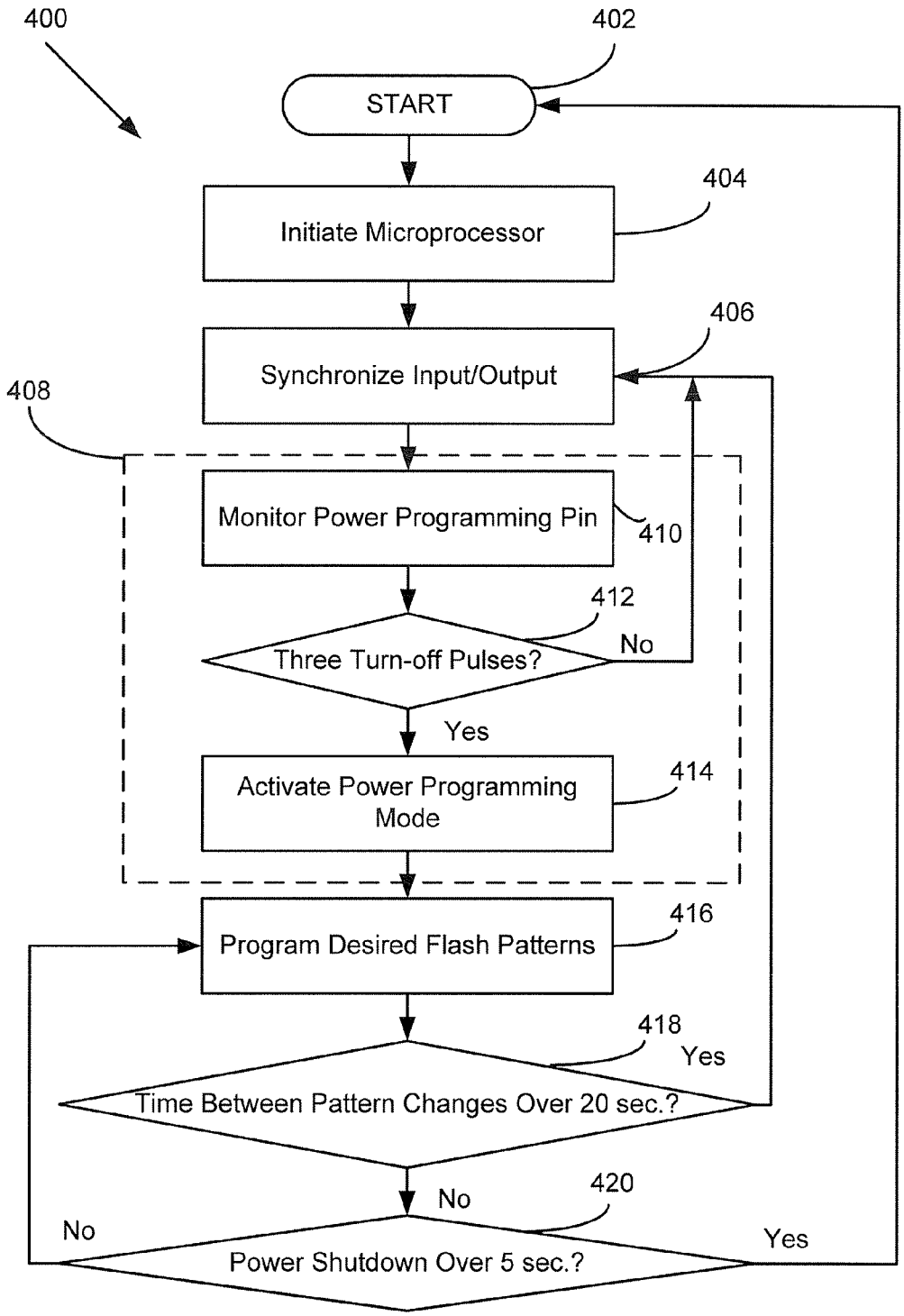
FIG. 4 shows a logic flow diagram of systems and methods for programming flash patterns according to a possible embodiment of the present disclosure.

Referring now to FIG. 4, systems and methods for programming flash patterns are shown according to a possible embodiment of the present disclosure. The system 400 is configured to set and program predetermined flash patterns for illuminating a light source in response to detecting or not detecting a predetermined sequence of actuations of a power button with a programmable circuit. In particular, when detecting a predetermined sequence of actuations, the system 400 allows for selection of a particular flash pattern from the set of available predetermined flash patterns and then stores the flash pattern in memory. When not detecting a predetermined sequence of actuations, the system 400 produces and delivers the flash pattern that has been previously stored in the memory. The system 400 is configured also to receive signals corresponding to pushing the power button to actuate predetermined flash patterns for illuminating the light source.

Operational flow within the system 400 is instantiated at a start operation 402. The start operation 402 corresponds to initiation of a factory calibration and setup of various registers in the system. Operational flow proceeds to a microprocessor initialization module 404. The microprocessor initialization module 404 turns off interrupts and turns the light source (e.g., LED's or lamps) off. The microprocessor initialization module 404 also provides a delay to allow the microcontroller power voltage time to stabilize, and then reads the values stored in the memory. In particular, the microprocessor initialization module 404 performs a power-up test when the microprocessor is powered up for the first time. This serves the purpose of simplifying the production test procedure. After the first time power-up and test routine is complete, future power-ups ignore the power-up testing routine. The flash pattern stored in the memory is then read and validated.

Operational flow proceeds to an input/output synchronization module 406. The input/output synchronization module 406 performs a synchronization of a sync output and sync input. The input/output synchronization module 406 determines an operating mode and flashes the light source accordingly. The operating mode includes a master mode producing the flash patterns and a slave mode waiting for an external sync input. In the master mode, the flash pattern read from the memory is being reproduced and sent to the light source power controller and the appropriate sync or alternating sync outputs. In the slave mode, the sync input is monitored and the signal to the light source power controller is produced accordingly. In absence of the sync signal for an extended time, an unsynchronized signal is produced by the microprocessor.

Operational flow proceeds to a power programming module 408. The power programming module 408 is configured to monitor the power programming pin status to allow the operating mode to switch between the master mode and the slave mode. Once the operating mode is in the master mode, the power programming module 408 allows a flash pattern selection. In particular, the power programming module 408 activates a power programming mode when the power programming pin status has been changed down/up for a predetermined number of times and has dwelled in each state within the predetermined time. In one possible embodiment, the power programming module 408 includes three sub-modules. The first sub-module is a power programming pin monitoring module 410. The power programming pin monitoring module 410 checks the power programming pin status and counts a status change when a status indicating line has gone down once and back up for a predetermined amount of time. Operational flow proceeds to a second sub-module of the power programming module 408. The second sub-module is a comparison operation 412. The comparison operation 412 determines whether the total status changes of the power programming pin are greater than the predetermined number. In one possible embodiment, the predetermined number is three. If the comparison operation 412 determines that the total status changes of the power programming pin are less than the predetermined number, then operational flow branches "No" to the input/output synchronization module 406, and operational flow proceeds as previously described, without changing the previously activated operating mode or flash pattern. If the comparison operation 412 determines that the total status changes of the power programming pin are same as or greater than the predetermined number, operation flow branches "Yes" to a power programming mode activation module 414, a third sub-module of the power programming module 408. The power programming mode activation module 414 triggers a power programming mode. In other words, each successive, quick, such as lasting approximately one second in the low state, down/up transition on the power programming pin, changes a flash pattern. The new flash pattern is then reproduced in the light source and in the synchronization output. In one possible embodiment, some flash patterns are defined as in the master operating mode and at least one other pattern is defined as in a slave operating mode.

Operational flow proceeds to a programming desired flash patterns module 416. As discussed above, once the power programming mode is triggered, each successive, quick down/up transition on the power programming pin changes a flash pattern. The programming desired flash patterns module 416 defines flash patterns and the sequence of the flash patterns to be programmed. The flash patterns can be saved in a memory or in a memory built in the microprocessor. In one possible embodiment, the memory is an Electrically Erasable Programmable Read-Only Memory (EEPROM). The memory can also be any other suitable type of memories. In one possible embodiment, the flash patterns are used for an emergency response vehicle.

The flash patterns may include Single Flash, Double Flash, Fast Double Flash, Pulsing Triple Flash, Triple Flash, 6× Flash, Quad Flash, Pulsing Double Flash, Pulsing Quad Flash, and Chopped Double Flash. In other words, it is meant that the light source can be illuminated in various ways. Various flash patterns are possible. For example, in the Single Flash pattern, the light source can be illuminated and flash on for 409 milliseconds and then off at 589 milliseconds intervals. The list of above flash patterns is only an example for flash patterns to be programmed. There are any number of flash patterns that can be programmed in the system. In addition, the light source may contain LED's of various colors to produce flashes of diverse colors. Obviously, the sequence of flash patterns can be also re-arranged. In other words, different flash patterns can follow other flash patterns in a different order. In one possible embodiment, at least one flash pattern is defined as a slave flash pattern. Namely, the slave flash pattern waits for an external synchronization signal and produces flashes synchronized with that signal. Particularly, only if such external synchronization signal is absent for a time determined to be abnormally long, for example two seconds or other predetermined time period, the slave flash pattern stored in the memory is produced until a proper external synchronization is received.

Operational flow proceeds to a comparison operation 418. The comparison operation 418 determines whether an interval of time between actuating a last quick down/up transition on the power programming pin is longer than a predetermined time period. A typical predetermined time period is about 20 seconds. If the comparison operation 418 determines that the interval time period between actuating the quick down/up transition on the power programming pin and programming a pattern is longer than the predetermined time period, then operational flow branches "Yes" to the input/output synchronization module 406, and operational flow proceeds as previously described. If the comparison operation 418 determines that the interval time period between actuating the quick down/up transition on the power programming pin and programming a pattern is not longer than the predetermined time period, operational flow branches "No" to a comparison operation 420.

The comparison operation 420 determines whether a power source for the system 400 has been shut down over a predetermined time period. A typical predetermined time period is five seconds. The predetermined time period is typically equal to the time that the power retaining circuit can hold the microprocessor power within its operating limits. If the comparison operation 420 determines that the power source has been shut down for over the predetermined time period, operational flow branches "Yes" to the start module 402, and operational flow proceeds as previously described. If the comparison operation 420 determines that the power source has not been shut down for over the predetermined time period, operational flow branches "No" to the programming desired flash patterns module 416, and operational flow proceeds as previously described. In one possible embodiment, the comparison operation 420 is implemented in hardware.

The foregoing disclosure can best be understood by an application example. Referring to FIGS. 2 and 4, a user pushes the power button 240, and the programmable circuit 280 reacts. In particular, when the lighting apparatus 200 has not been turned on, the user first pushes the power button 240 to electrically connect the power source 220 to the programmable circuit 280 and the light source 260. Referring to FIG. 4, the system 400 is then instantiated at the start operation 402. The microprocessor initialization module 404 performs a microprocessor initialization. The input/output synchronization module 406 determines an operating mode by sending a proper sync output or waiting for a sync output. The input/output synchronization module 406 also produces a flash pattern for the light source. After the system 400 has been powered up and initialized, the power programming module 408 checks a power programming pin status and activates a power programming mode when the power programming pin status has been changed down/up for a predetermined number of times. As long as the power programming mode is not active, the flash pattern previously stored in the memory is repeatedly produced. For example, a single flash pattern stored in the memory is reproduced repeatedly, but when the user pushes the power button on/off sequentially and continuously for the predetermined number of times, e.g., three times in a continuous sequence, the power programming mode activation module 414 triggers a power programming mode. At this point, each successive quick down/up transition on the power programming pin changes a flash pattern, which replaces the single flash pattern with a new flash pattern. The new flash pattern is then stored in the memory. Accordingly, the light source 260 is illuminated according to the new flash pattern. Generally, this new flash pattern will be stored indefinitely until the system 400 exits the power programming mode, for example either by no further pattern changes in a predetermined time (e.g., 20 seconds) or by a power down over a time period (e.g., 5 seconds).

Figure 5:
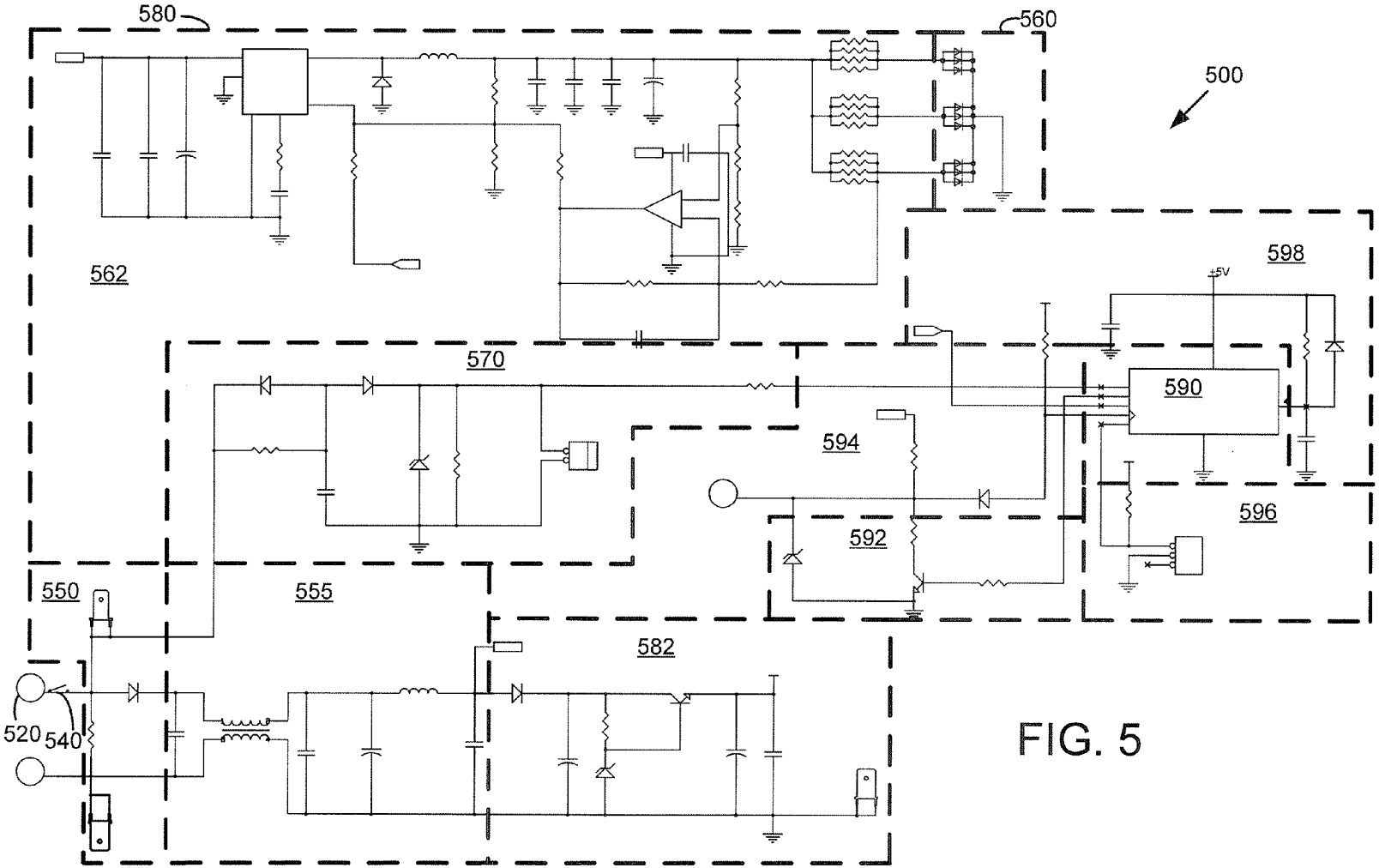
FIG. 5 shows an electrical schematic of a lighting apparatus and system is shown according to a possible embodiment of the present disclosure.

Referring now to FIG. 5, an electrical schematic of a lighting apparatus and system 500 is shown according to a possible embodiment of the present disclosure. Preferably, the lighting system 500 includes a power source 520, a power button 540, a light source 560, and a programmable circuit 580. The power source 520 is in electrical communication with the light source 560 via the power button 540. The power button 540 is configured and arranged to control electrical flow from the power source 520 to the light source 560. The programmable circuit 580 is in electrical communication with the power source 520, the power button 540, and the light source 560.

Preferably, the programmable circuit 580 includes a power input circuit 550 and a power input filter circuit 555, which provide a suitable power for operations of components in the programmable circuit 580. The programmable circuit 580 also includes a power programming circuit 570 and a power retaining circuit 582, which provide inputs and power for a microprocessor 590 in the programmable circuit 580. Besides the microprocessor 590, the programmable circuit 580 further includes various auxiliary circuits to provide necessary inputs/outputs and initialization to support running the microprocessor 590 in the programmable circuit 580. The various auxiliary circuits, for example, include a sync/alternate output 592, a sync input 594, a sync/alternate output selection 596 and a power-up reset 598. Finally, the programmable circuit 580 includes a light source power controller 562, which controls the power flowing to the light source 560 and responds to the on and off commands from the microprocessor 590 by turning the light source 560 on and off or modifying the power level.

Figure 6:
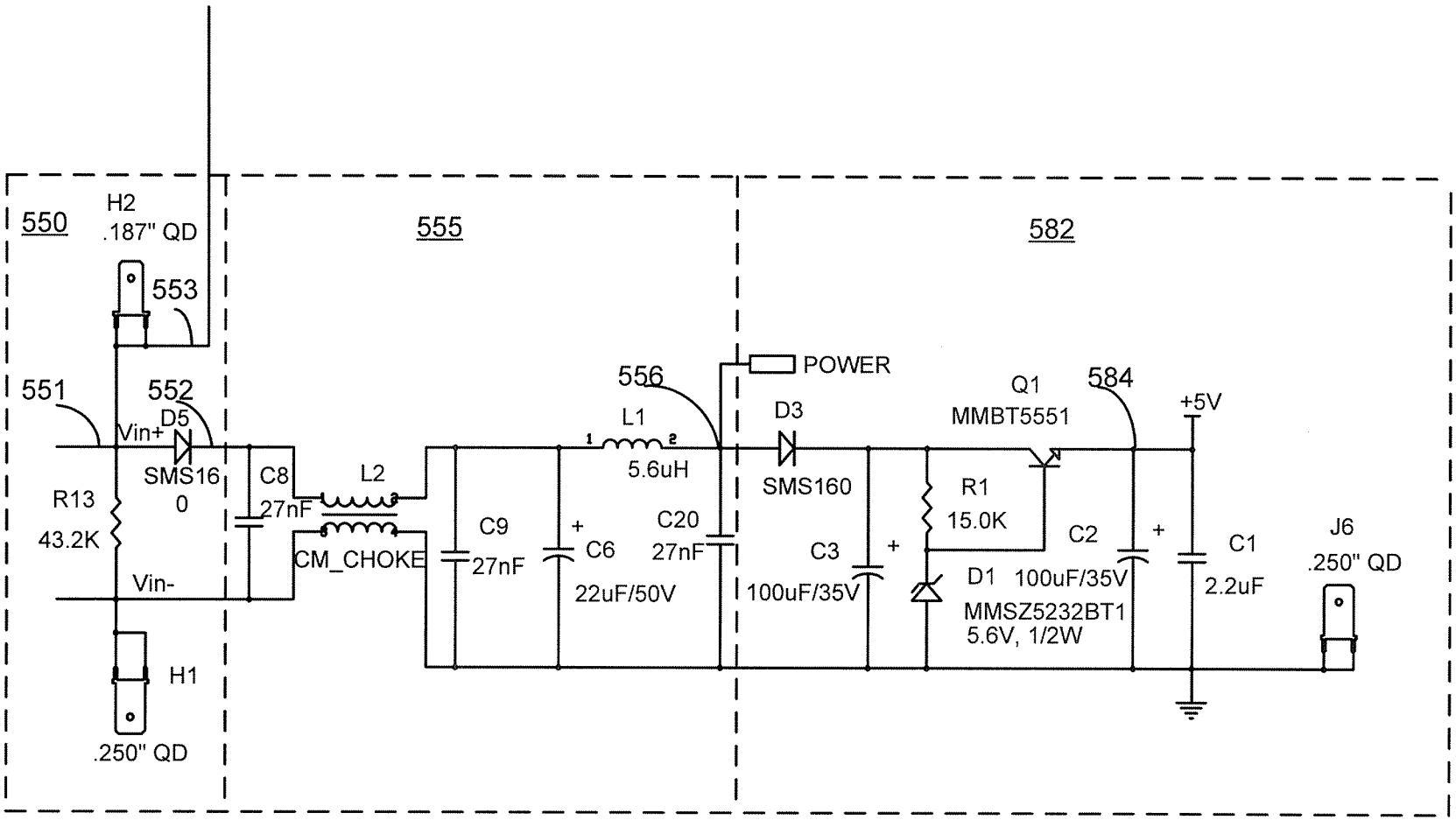
FIG. 6 shows a portion of the electrical schematic of the lighting apparatus and system in FIG. 5.

The components, general steps and operations of the system 500 are illustrated in detail in FIGS. 6-9 and described as following. Referring to FIG. 6, a portion of the electrical schematic of the lighting apparatus and system 500 in FIG. 5 is shown according to a possible embodiment of the present disclosure. The power input circuit 550 receives a power input 551 from the power source 520 through a control of the power button 540. The power input circuit 550 provides a first power output 552 to the power input filter circuit 555. The power input 551 also provides a second power input 553 to the power programming circuit 570. The power input circuit 550 is configured and arranged to provide a reverse polarity protection of the power source 520.

The power input filter circuit 555 receives the first power output 552 from the power input circuit 550. The power input filter circuit 555 filters the first power output 552. The power input filter circuit 555 generates a third power output 556 to the light source power controller 562 and the power retaining circuit 582. The third power output 556 provides power for electrical operations in the light source power controller 562 and the light source 560.

The power retaining circuit 582 receives the third power output 556 from the power input filter circuit 555. The third power output 556 continues to run through the power retaining circuit 582. The power retaining circuit 582 generates a fourth power output 584. Preferably, a voltage of the fourth power output 584 is kept at about 5 volts for the fourth power output 584 to be used as a power input for the microprocessor 590. Further, the power retaining circuit 582 is configured and arranged to retain the fourth power output 584 in an approximately same power voltage level after the power source 520 is turned off. The fourth power output 584 can typically be kept in the same power voltage level for about 2 to 5 seconds even after the power source 520 is turned off.

Figure 7:
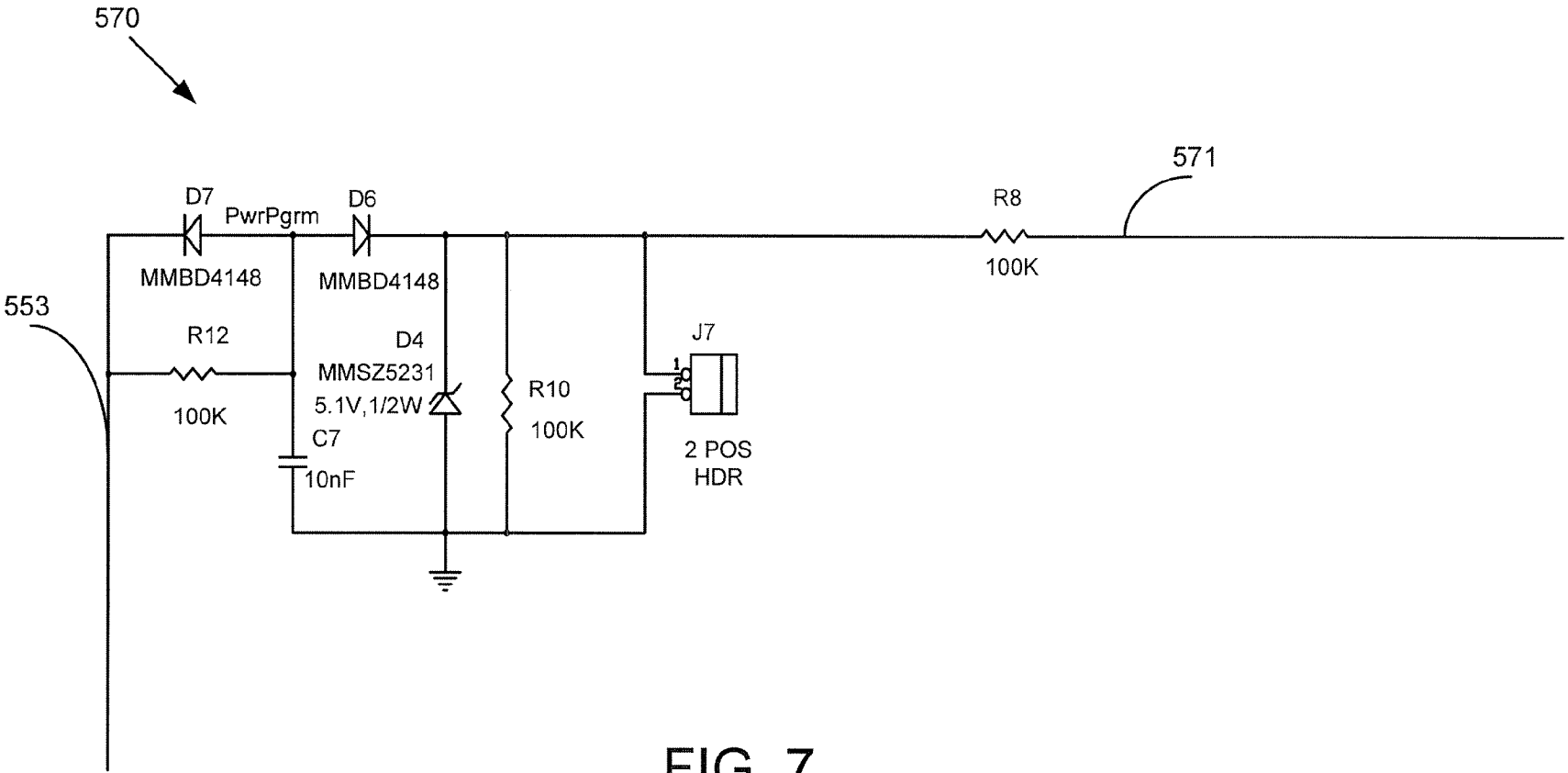
FIG. 7 shows a power programming circuit of the electrical schematic of the lighting apparatus and system in FIG. 5.

Referring to FIG. 7, the power programming circuit 570 of the electrical schematic of the lighting apparatus and system 500 in FIG. 5 is shown according to a possible embodiment of the present disclosure. The power programming circuit 570 receives the second power output 553 from the power input circuit 550. The power programming circuit 570 transforms the second power output 553 into a logical signal 571. The power programming circuit 570 generates the logical signal in response to turning on and off the power source 520. For example, when the power source 520 is turned on, the logical signal 571 has a high logic level. On the other hand, when the power source 520 is turned off, the logical signal 571 has a low logic level.

Figure 8:
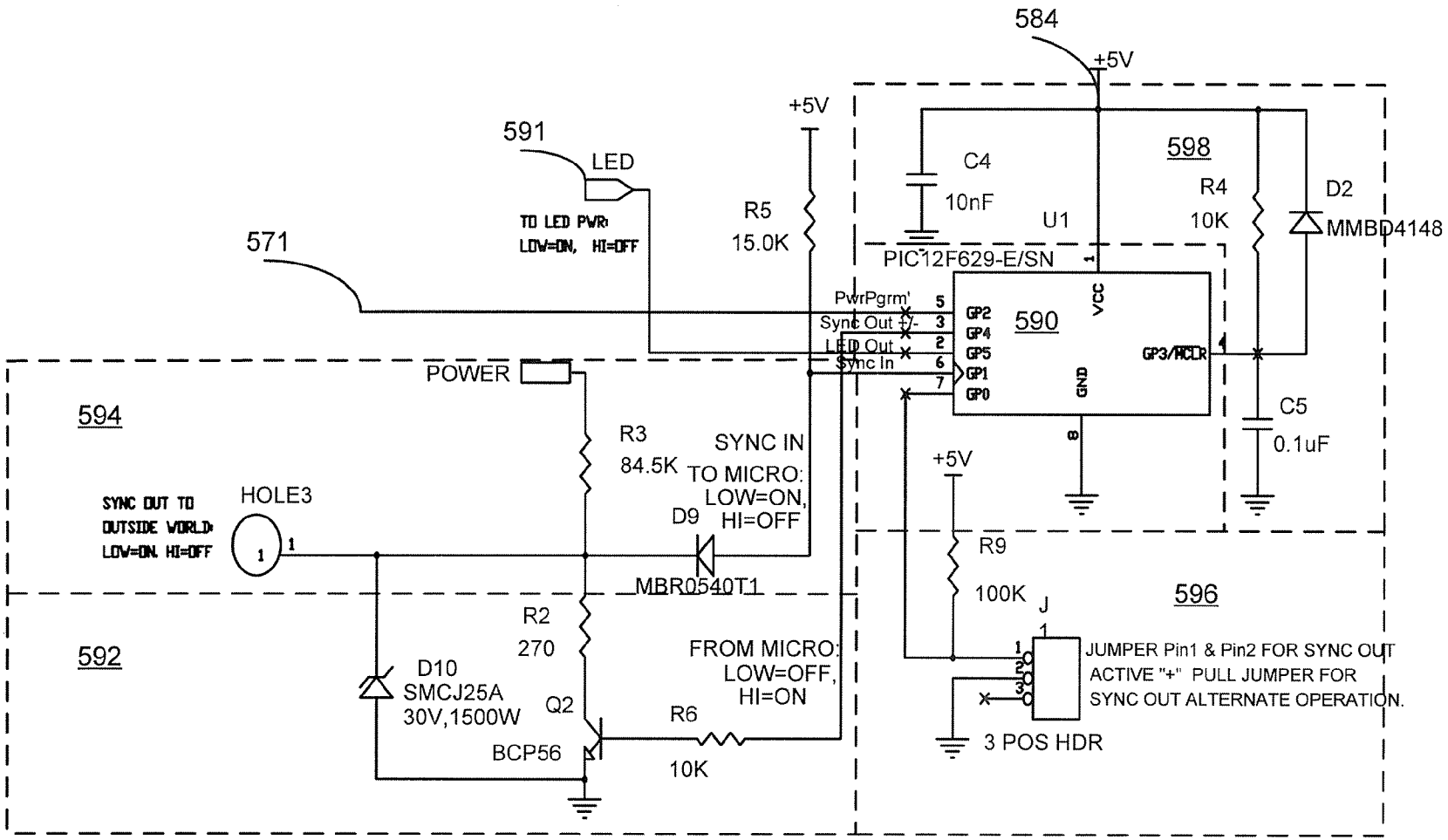
FIG. 8 shows a microprocessor and its various auxiliary circuits of the electrical schematic of the lighting apparatus and system in FIG. 5.

Referring to FIG. 8, the microprocessor 590 and its various auxiliary circuits of the electrical schematic of the lighting apparatus and system 500 in FIG. 5 are shown according to a possible embodiment of the present disclosure. The microprocessor 590 receives the fourth power output 584 from the power retaining circuit 582 as a power input to keep the microprocessor 590 running. The microprocessor 590 also receives the logical signal 571 to monitor the power on/off state of the power source 520. As discussed above, the various auxiliary circuits are provided to support running and executing the microprocessor 590 in the programmable circuit 580. The sync/alternate output 592, the sync input 594, and the sync/alternate output selection 596 provide synchronization and I/O data communication for the microprocessor to synchronize several similar lighting apparatus to flash together or flash alternately with the lighting apparatus 500. The power-up reset 598 provides a function for the microprocessor 590 to be reset. The microprocessor 590 delivers a control signal 591 to the light source power controller 562 for illuminating the light source 560 according to the predetermined flash patterns. Preferably, the microprocessor 590 is a microcontroller made from Microchip Technology Inc. A typical model used in the system 500 is PIC12F629. The microprocessor 590 can also be any other suitable types of processors or microcontrollers or control circuits.

Figure 9:
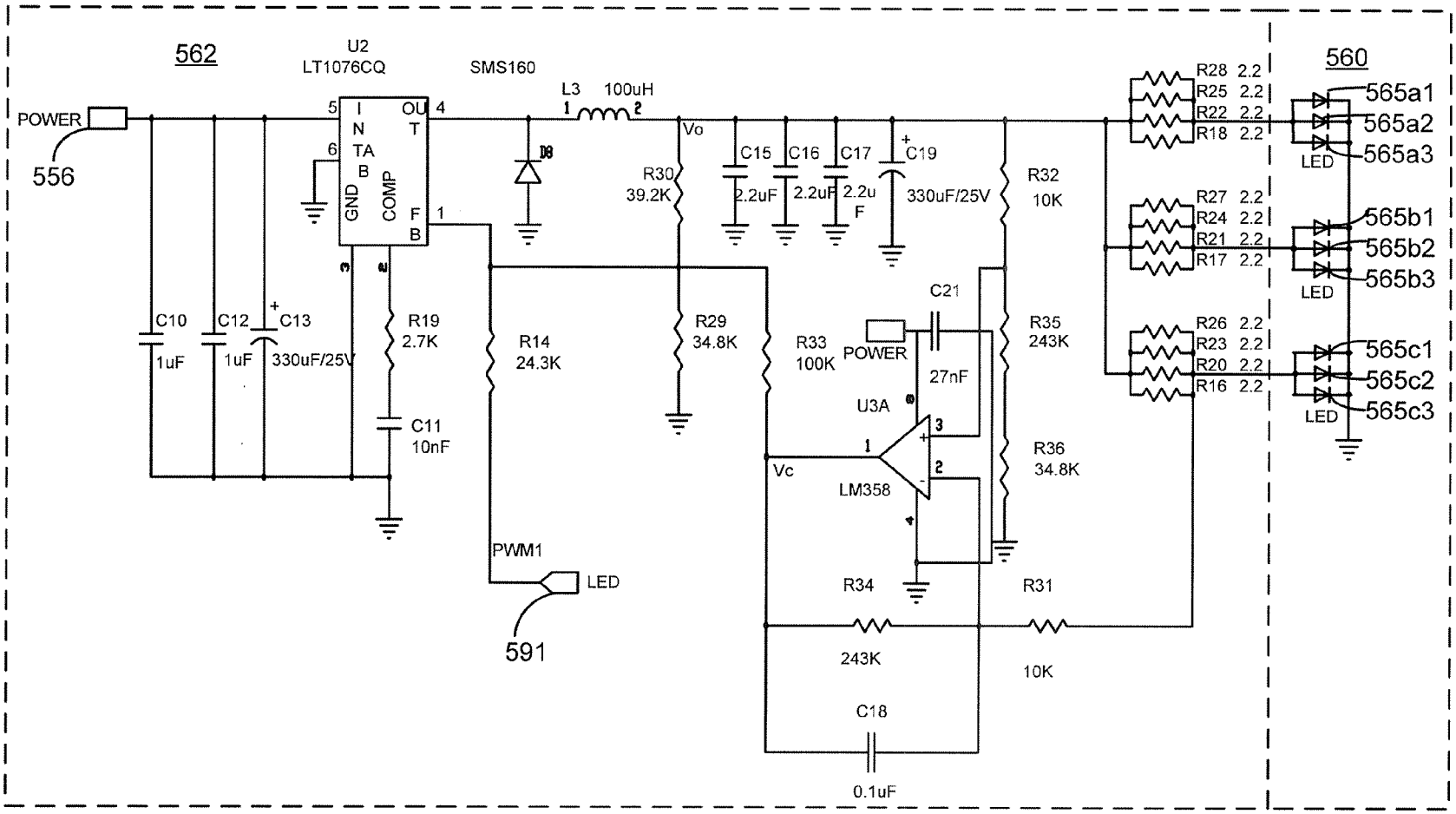
FIG. 9 shows a light source power controller and a light source of the electrical schematic of the lighting apparatus and system in FIG. 5.

Referring now to FIG. 9, the light source power controller 562 and the light source 560 of the electrical schematic of the lighting apparatus and system 500 in FIG. 5 are shown according to a possible embodiment of the present disclosure. The programmable circuit 580 includes the light source power controller 562, which controls the power level and the on and off of the light source 560. The light source power controller 562 receives the third power output 556 from the power input filter circuit 555. The light source power controller 562 also receives the control signal 591 from the microprocessor 590 to eventually control the light source 560 to flash. Preferably, the light source 560 includes one or more LED's 565*a*1-565*c*3. The light source 560 can also include any other suitable source such as a lamp.

The various embodiments described above are provided by way of illustration only and should not be construed to limit the invention. Those skilled in the art will readily recognize various modifications and changes that may be made to the present invention without following the example embodiments and applications illustrated and described herein, and without departing from the true spirit and scope of the present invention, which is set forth in the following claims.

What is claimed is:

1. A lighting apparatus comprising:
a light source;
a power source in electrical communication with the light source;
a power button arranged to control electrical flow from the power source to the light source; and
a programmable circuit in electrical communication with the power button, the programmable circuit programmed to set a flash pattern selected from among a plurality of predetermined flash patterns for illuminating the light source in response to detecting a predetermined sequence of actuations of the power button;
wherein the programmable circuit is further programmed to trigger a power programming mode when there are a predetermined number of continuous up/down pulses in the logic signal, and deliver a control signal for illuminating the light source when the predetermined flash patterns are programmed.

2. The lighting apparatus of claim 1, wherein the programmable circuit is programmed to store in memory a flash pattern which is selected in response to detecting the predetermined sequence of actuations of the power button.

3. The lighting apparatus of claim 1, wherein the programmable circuit is programmed to deliver a flash pattern stored in memory when not detecting the predetermined sequence of actuations of the power button.

4. The lighting apparatus of claim 1, wherein the programmable circuit comprises a power retaining circuit configured and arranged to retain a power after the power source is turned off.

5. The lighting apparatus of claim 4, wherein the programmable circuit further comprises a power programming circuit configured and arranged to generate a logical signal in response to turning on and off the power source.

6. The lighting apparatus of claim 1, wherein the predetermined number is about three.

7. The lighting apparatus of claim 1, wherein the microprocessor is programmed to terminate the power programming mode when no predetermined sequence is received over a predetermined time period after the power programming mode is triggered.

8. The lighting apparatus of claim 7, wherein the predetermined time period is about 20 seconds.

9. The lighting apparatus of claim 1, wherein the microprocessor is programmed to restart the microprocessor when the power source has been shut down for over a predetermined time period.

10. The lighting apparatus of claim 9, wherein the predetermined time period is about five seconds.

11. The lighting apparatus of claim 1, further comprising a light source power controller being in electrical communication with the light source.

12. The lighting apparatus of claim 11, wherein the light source is a light emitting diode (LED).

13. The lighting apparatus of claim 12, wherein the light source power controller is an LED power controller.

14. The lighting apparatus of claim 11, comprising a power input filter circuit filtering the power source and generating a power for the light source power controller.

15. The lighting apparatus of claim 1, further comprising a power input circuit configured and arranged to provide a reverse polarity protection of the power source.

16. A method of using a light source, the method comprising:

controlling electrical flow from a power source to the light source; and setting a flash pattern selected from a plurality of predetermined flash patterns for illuminating the light source in response to detecting a predetermined sequence of actuations of a power button, wherein setting the flash pattern includes generating a logical signal in response to the predetermined sequence of actuations of the power button, the logical signal triggering a power programming mode, and delivering control signals for illuminating the light source.

17. The method of claim 16, further comprising:

storing in memory a flash pattern which is selected in response to detecting the predetermined sequence of actuations of the power button.

18. The method of claim 16, further comprising:

delivering a flash pattern stored in memory when not detecting the predetermined sequence of actuations of the power button.

19. The method of claim 16, comprising retaining a power after the power source is turned off.

20. The method of claim 16, comprising terminating the power programming mode when no predetermined sequence is received over a predetermined time period after the power programming mode is triggered.

21. The method of claim 16, comprising providing a reverse polarity protection of the power source.

22. A lighting system comprising:

a light source;

a power source in electrical communication with the light source;

a power button arranged to control electrical flow from the power source to the light source; and a programmable circuit in electrical communication with the power button, the programmable circuit including a microprocessor programmed to:

trigger a power programming mode when there are a predetermined number of continuous up/down pulses in the logic signal; and deliver a control signal for illuminating the light source when the predetermined flash patterns are programmed;

and wherein the programmable circuit is further programmed to set predetermined flash patterns for illuminating the light source in response to detecting a predetermined sequence of actuations of the power button.

23. The lighting system of claim 22, wherein the programmable circuit is programmed to store in memory a flash pattern which is selected in response to detecting the predetermined sequence of actuations of the power button.

24. The lighting system of claim 22, wherein the programmable circuit is programmed to deliver a flash pattern stored in memory when not detecting the predetermined sequence of actuations of the power button.

25. The lighting system of claim 22, wherein the programmable circuit comprises:

a power retaining circuit configured and arranged to retain a power after the power source is turned off;

a power programming circuit configured and arranged to generate a logical signal in response to turning on and off the power source.

26. The lighting system of claim 25, wherein the microprocessor is programmed to terminate the power programming mode when no predetermined sequence is received over a predetermined time period after the power programming mode is triggered.

27. The lighting system of claim 25, wherein the microprocessor is programmed to restart the microprocessor when the power source has been shut down for over a predetermined time period.

28. The lighting system of claim 25, further comprising a light source power controller being in electrical communication with the light source.

29. The lighting system of claim 28, wherein the light source is an LED.

30. The lighting system of claim 29, wherein the light source power controller is an LED power controller.

31. The lighting system of claim 25, comprising a power input filter circuit filtering the power source and generating a power for the light source power controller.

32. The lighting system of claim 25, further comprising a power input circuit configured and arranged to provide a reverse polarity protection of the power source.

* * * * *